US006354969B1

(12) United States Patent
Sullivan

(10) Patent No.: US 6,354,969 B1
(45) Date of Patent: Mar. 12, 2002

(54) INSTRUCTIONAL METHOD AND SYSTEM FOR TEAM SPORTS

(76) Inventor: Patricia A. Sullivan, 3 Snyder Ave., Keansburg, NJ (US) 07734

( * ) Notice: Subject to any disclaimer, the term of this patent is extended or adjusted under 35 U.S.C. 154(b) by 0 days.

(21) Appl. No.: 09/344,418

(22) Filed: Jun. 26, 1999

(51) Int. Cl.[7] ..... A63B 71/00

(52) U.S. Cl. ..... 473/502; 458/464; 458/422; 458/470; 458/469

(58) Field of Search ..... 2/69, 69.5, 115, 2/102, DIG. 11, 912–913, 918, 246, 171, 80, 919; 434/247, 395; 446/26, 901; 473/438, 490, 501–503; 273/440, DIG. 30

(56) References Cited

U.S. PATENT DOCUMENTS

| | | | | | |
|---|---|---|---|---|---|
| 3,063,718 | A | * | 11/1962 | Steinkamp | 473/502 |
| 3,580,573 | A | * | 5/1971 | Noonan | 473/470 |
| 5,290,043 | A | * | 3/1994 | Vidinic | 473/446 |
| 5,694,651 | A | * | 12/1997 | Thomas | 2/69 |
| 6,004,232 | A | * | 7/1998 | Sennott | 473/502 |
| 5,823,012 | A | * | 10/1998 | Hacskaylo | 2/170 |
| 5,953,757 | A | * | 9/1999 | Blanks | 2/243.1 |

OTHER PUBLICATIONS

Edited by George Sullivan, Produced by Charles Fellows, Football Rules Illustrated, A fireside Book, Plublished by Simon & Schuster, Chapter 5, 1981.*

* cited by examiner

*Primary Examiner*—Jeanette Chapman
*Assistant Examiner*—Mitra Aryanpour

(57) ABSTRACT

A sports instructional method is disclosed. For man-to-man defense, players on opposing squads are "matched" as a function of their playing assignments. In some embodiments, such a match is made between a player from a first squad that has a defensive playing assignment that requires "guarding" or "covering" a player on a second squad that has a particular offensive playing assignment. Matched players are provided with "tags" that are visually associative of one another, such that the players will recognize each other as their coverage assignment. In various embodiments, the tag is a headband, an armband, etc. For zone defense, a first tag is used to demarcate a zone within a playing field, and a second tag that is visually associative of the first tag is provided to a player having a playing assignment that requires defending the demarcated zone. The second tag may be, for example, a line formed from lime, etc.

3 Claims, 9 Drawing Sheets

INSTRUCTIONAL METHOD AND SYSTEM FOR TEAM SPORTS

FIELD OF THE INVENTION

The present invention relates to an instructional method and system for sports. More particularly, the present invention relates to a method and system for teaching young children to play team sports.

BACKGROUND OF THE INVENTION

Team sports such as basketball, football, soccer, and the like are played with two opposing squads, one of which is in an offensive posture and the other of which is in a defensive posture at any moment during play. For league play, each of such opposing squads includes a specified number of players, each having a specific playing "assignment" while on the playing field (e.g., basketball center, football quarterback, soccer forward, etc.).

Certain duties or responsibilities are typically associated with a player's playing assignment. For team sports in which the same players are on the field for both offensive and defensive play (e.g., basketball, soccer, etc.), playing assignments will necessarily include both offensive and defensive duties. For team sports in which there are separate offensive and defensive squads (e.g., football, etc.), the playing assignments are either primarily offensive (e.g., quarterback, wide receiver, etc.) or primarily defensive (e.g., middle linebacker, safety, etc.) The complementary defensive/offensive postures of opposing squads gives rise to natural pairings or associations between players of such opposing squads. Taking football as an example, such a pairing exists between cornerbacks of the team on defense and wide receivers of the team on offense.

At a high school or more advanced level of play, players do not have difficulty in understanding and executing their assigned duties. Such understanding and execution is rarely exhibited, however, by young children playing such sports. Rather, confusion reigns. And such confusion, which results in part from an inadequate understanding of the game being played and for the duties associated with their playing assignments, exposes young children and children with learning disabilities to preventable safety risks.

One of such safety risks involves injury from intentional contact. Children will often ignore their playing assignment and shove, trip, tackle and jump on opposing teammates, or even their own teammates, to get the ball—or the child that has the ball. And while team sports such as football, hockey, basketball and the like do properly involve physical contact (e.g., tackling, checking, picking, etc.), the type of the contact more typically exhibited by such child athletes is perhaps best characterized as a "personal foul."

Beyond the risk of injury from deliberate contact, there is also a risk of injury from unintentional contact. It will be appreciated that ten or more children converging on a specific area of the playing field or court to "get the ball" tends to result in many unintentional collisions.

There is a dearth of sports instructional systems or methods for young children in the prior art. U.S. Pat. No. 5,694,651 is directed to a method of position color identification for coaching in multi-player athletic environments. According to that patent, a plurality of color-keyed vests are used to distinguish individual player positions. During a practice session, one of either the defensive or offensive squad wears such vests. The patent indicates that such position color identification allows a coach to readily identify individual positions and players during rapid play action to isolate mistakes without having to review video of the action, which is time consuming, expensive and inefficient.

Accordingly, a need remains for a system and method for use in teaching young children or those with learning disabilities to play team sports while significantly decreasing the incidence of injury.

SUMMARY OF THE INVENTION

In accordance with the illustrated embodiments of the present invention, players on one squad are "linked to" or "associated with" players on an opposing squad (when man-to-man defense is being taught) or a region of the playing field (when zone defense is being taught). Such a link or association is provided through "tags," that are indicative of a playing assignment (when in use).

In one embodiment, wherein man-to-man defense is used, tags are provided to players on a first squad. In various embodiments, the tag is a headband, an armband, a waistband, a "flag" that attaches to a player's jersey, or the like. Each tag comprises a "marker" that distinguishes a given tag from at least some of the other tags provided to other players on the first squad. In various embodiments, the marker is a color, symbol, shape, pattern and combinations thereof.

Players on a second opposing squad are likewise provided with a tag. Those tags "correspond," as a function of a player's playing assignment, to a tag provided to the player with a "complementary" playing assignment on the first squad. In the present context, "complementary" is intended to denote a pairing between offensive and defensive players/playing assignments such as wherein the defensive playing assignment is to "guard" or "cover" a player having a particular offensive playing assignment (e.g., in football: wide receiver and corner back, etc.).

The above-noted "correspondence" between tags is provided through visual association. Such visual association is promoted through the use of similar or identical markers on such tags. For example, two players having complementary playing assignments may both be provided with a red tag. In that manner, the players of the squad on defense can readily determine which player on the opposing squad to cover.

In a second embodiment, wherein zone defense is used, first tags are used to demarcate regions of the playing field. Such regions or zones indicate a portion of the playing field that a player must defend when that player's squad is in a defensive posture. In such an embodiment, the first tag is realized in a form suitable for demarcating a region of the playing field. For example, in one embodiment, the tag is a "line(s)", such as may be formed from powder (e.g., lime), to demarcate the zones. As in the first embodiment, the first tag comprises a "marker" that distinguishes a given first tag for defining a first zone from other first tags defining other zones. For example, in one embodiment, the marker is the color of the lines.

Players are provided with a second tag as a function of playing assignment. In particular, a player having a playing assignment that requires providing defensive coverage in a particular zone is given a second tag that is visually associative of the first tag that defines that zone. For example, if a zone is defined by white lines, the second tag provided to the player can be, for example, a white armband, etc.

The invention provides coaches with a means to help children understand and follow the duties of their playing assignment. Such understanding will improve discipline on the field-of-play and improve the level of play. And, most importantly, such increased understanding and discipline will decrease the incidence of injuries caused by the confusion hitherto prevailing when young children play team sports.

DETAILED DESCRIPTION

Figure 1A:
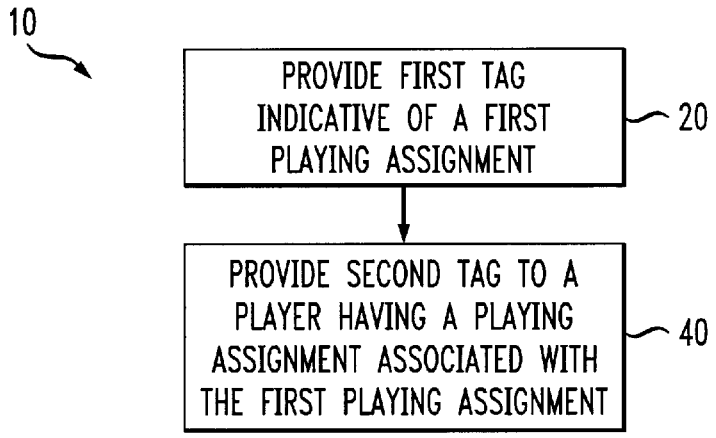
FIG. 1A depicts a flow diagram of an instructional method in accordance with an illustrated embodiment of the present invention.

The present invention is directed to a sports instructional method and system that is particularly advantageous for teaching young children and children with learning disabilities to play team sports. The invention not only provides a teaching and learning aid, but also is useful for reducing the incidence of sports injuries. In view of its utility for reducing injury, the method and system is useful for inter-team competition as well as for intra-team scrimmages (e.g., practice sessions).

The present system is useful in conjunction with a variety of team sports. Such team sports are typically played with two opposing squads. At any moment during play, one of the squads is in "on offense" or "in possession" (i.e., has possession of the "ball," "puck," etc.) and the other squad is "on defense" (i.e., attempts to prevent advance of the team in possession).

In some embodiments of the present invention, the first and second squads are composed of players that belong to the same team. An example of such an embodiment is a practice scrimmage, wherein players of a single team are divided into two squads that oppose each other on the field-of-play in a practice session. In other embodiments, the first and second squads are comprised of players belonging to different teams, such as when two teams meet in competitive play for league ranking. As used in this Detailed Description and in the appended claims, the term "squad" is used to refer to both such embodiments unless otherwise indicated. Moreover, as used herein, the terms and phrases "field," "field-of-play," "playing field," "court" and the like are used interchangeably and are not intended to be used in an exclusionary manner.

In some embodiments, the present system and method are used to teach team sports that have dedicated offensive and defensive squads, such as football. In other embodiments, the present invention is used in conjunction with team sports wherein a given squad plays both defense and offense as a function of whether it, or an opposing squad, is in possession. Examples of the latter type of team sports include, without limitation, basketball, hockey, soccer, lacrosse, field hockey and rugby.

As will be appreciated by those that are familiar with team sports, each of the players on a squad plays a specific role that is defined by the player's "playing assignment." The nature of the playing assignments, and the required number of such assignments, are dictated by the sport being played. An abbreviated list of illustrative playing assignments include, for example, for basketball: center and power forward; for soccer: goal keeper and mid-fielder; for hockey: right wing and left wing; and for football: quarterback and middle linebacker.

Specific duties and responsibilities, which are well known to those who are familiar with team ports, are associated with the various playing assignments. For example, a basketball "center" is typically expected to "post up offensively;" that is, to receive the ball with his back to the basket and use pivot moves to hit a variety of close range shots as well as to recover offensive "rebounds." A soccer goal keeper's duty is to keep the ball out of his goal. In hockey, the "right wing" typically keeps to the right side of the rink playing both offensively and defensively. And a football "quarterback" receives the ball from the "center" and then hands it off to a "running back," throws it to a "receiver," or keeps it and runs.

To restrict the offensive moves of a first squad in possession, the second opposing squad plays defensively. Defensive strategies, even within the context of a given sport, vary widely. Such defensive strategies can, however, be grouped into two broad categories: "man-to-man" and "zone."

In a classical man-to-man defense, a player from the squad that is on defense "covers" a player from the squad that is on offense. Regardless of where on the field the offensive player moves, the defensive player accompanies the offensive player. In many team sports, a natural defensive-offensive pairing exists between players on opposing squads. One such pairing is between players of opposing squads that have the same playing assignment. For example, in basketball, opposing "centers" might cover one another in a man-to-man defense. A second pairing is between players of opposing squads that have "mirror image" playing assignments. Hockey provides an example of such "mirror image" assignments wherein the "right wing" of a first squad is responsible for the same portion of the rink as the "left wing" of the opposing squad.

In a "zone" defense, the players of the squad on defense are responsible for defending an area of the playing field instead of defending a particular opposing player. Even within a given sport, many implementations of zone defenses exist (e.g., in football: the "4-3" defense, the "3-4" defense, the "3-4 Eagle" defense, the "Dallas 4-3" defense, the "Flex" defense, the "Kansas City Falcon" defense, the "over/under 4-3," etc.). Generally, zone defenses are more complicated than man-to-man to execute. As such, man-to-man defense is often taught in preference to zone defense when instructing young children. Beyond classical man-to-man and zone defenses, there are hybrid defenses wherein some players on a squad play man-to-man defense while others play a zone defense. As will become more apparent later in this Specification, the present invention is applicable to man-to-man, zone and hybrid defenses.

FIG. 1A depicts, via flow chart, sports instructional method 10 in accordance with the present invention. In operation 20 of method 10, a first "tag" that, in use, is indicative of a first playing assignment, is provided. In operation 40, a second tag is provided to a player having a playing assignment that is "associated" (hereinafter "associated playing assignment") with the first playing assignment.

As used herein, the phrase "associated playing assignment" signifies a playing assignment that is the same as the first playing assignment or is a "complement" thereof (e.g., a coverage or defensive assignment that "matches up" with the first playing assignment).

The first and second tags are "visually associative" of one another. As used herein, the phrase "visually associative," denotes tags that have one or more similar, and preferably, identical attributes or characteristics that would enable a child viewing both tags to make an association or connection between such tags. As described further later in this specification, such visual association is provided by a marker included with each of the first and second tags.

Method 10 is perhaps best understood with reference to methods 100, 110 and 120, which are specific embodiments of method 10 as implemented for man-to-man, zone and hybrid defenses, respectively. As such, further description of method 10 is deferred until later in this Specification.

Figure 1B:
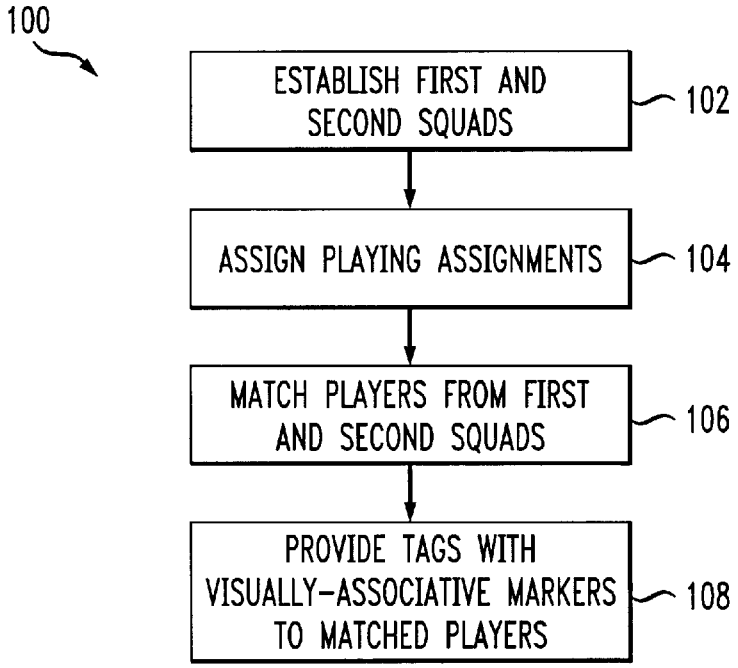
FIG. 1B depicts an embodiment of the instructional method of FIG. 1A, wherein the method is specifically adapted for teaching/learning man-to-man defense.

FIG. 1B depicts, via flow chart, sports instructional method 100 for man-to-man coverage in accordance with an illustrated embodiment of the present invention. In accordance with the operation block 102, first and second squads are established.

In operation 104, playing assignments are assigned to players on each of a first and a second squad. In operation 106, one or more players from the first squad are "matched" with one or more players from the second squad having "associated" playing assignments. In one embodiment, matching operation 106 involves consideration of the typical responsibilities associated with the various playing assignments of the various players on opposing squads. In many cases, the defensive responsibilities of a particular playing assignment will suggest, or even dictate a match. In other cases, more latitude is present and there may be more than one acceptable candidate for the match. In some embodiments, the abilities of the individual players may contribute to the decision of which opposing players to match. Illustrative matches of players on opposing squads as a function of playing assignment are presented later in this Specification for several different team sports.

While the aforedescribed "matching" is often symmetric or mutual (i.e., the first squad player covers the second squad player and, when possession changes, the second squad player covers the first squad player), such symmetry is not required and may, in some cases, be undesirable.

It will be understood that operations 102–106 of illustrative method 100 need not be implemented in the indicated order. In particular, in alternate embodiments, a first operation of a method in accordance with the present teachings comprises matching playing assignments. In other words, even before squads are established and playing assignments are assigned to players, opposing playing assignments are matched. As an example of an implementation of such an alternate method, representatives of an athletic association for a particular sport meet before the season begins and perform the matching operation. Teams are later fmalized and then playing assignments are assigned to players. Such an alternate method is within the contemplated scope of method 100.

Continuing with FIG. 1B, after the players on opposing squads have been matched in accordance with operation 106, tags are provided to the players, as indicated in operation 108. It is essential that the tags that are provided to "matched" players (or players having matched playing assignments) are "visually associative" of each other (as previously defined) and visually distinct from those of other matched players.

As previously indicated, the first and second tags each include a marker, and the marker on the tags provided to matched players display similar or identical attribute(s) such that the required visual association results. Examples of markers suitable for use in conjunction with some embodiments of the present invention include, without limitation, color, shapes, symbols, patterns and combinations thereof. Thus, as an example, the tags provided to matched players each include a marker having the same color, etc., providing the requisite visual association. FIGS. 2*a*–2*d* depict respective illustrative markers for use with a team sport played with five-man squads, such as basketball squad.

Figure 2A:
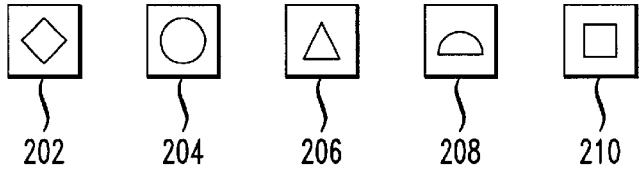
FIG. 2A depicts five illustrative "shape" markers in accordance with the present teachings.
Figure 2B:
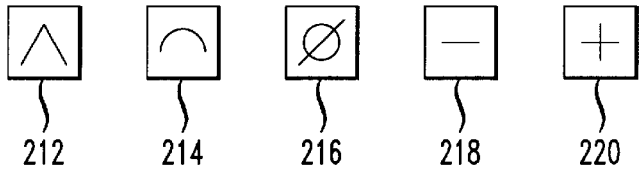
FIG. 2B depicts five illustrative "symbol" markers in accordance with the present teachings.
Figure 2C:
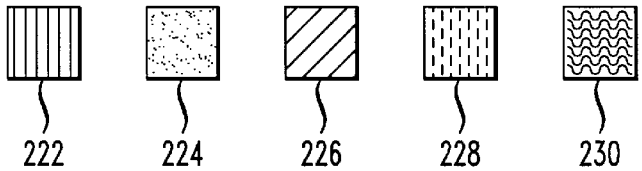
FIG. 2C depicts five illustrative "pattern" markers in accordance with the present teachings.
Figure 2D:
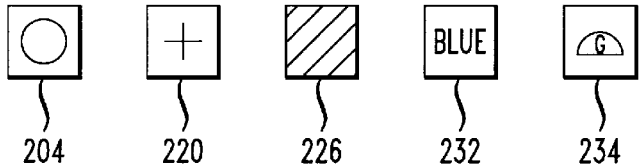
FIG. 2D depicts an illustrative combination of shape, symbol, pattern, color and compound markers in accordance with the present teachings.

In particular, FIG. 2*a* depicts five illustrative "shape" markers 202–210. The depicted shape markers include diamond 202, circle 204, triangle 206, semi-circle 208 and square 210. FIG. 2*b* depicts five illustrative "symbol" markers, including arrow 212, concave downward arc 214, circle with slash 216, bar 218 and cross 220. FIG. 2*c* depicts five illustrative "pattern" markers. The pattern markers depicted in FIG. 2*c* include vertical lines 222, dots 224, slanted lines 226, vertical dashed lines 228 and wavy lines 230. FIG. 2*d* depicts a combination of shape, symbol and pattern markers, as well as color markers. In particular, the depicted combination includes circle (shape marker) 204, cross (symbol marker) 220, and slanted lines (pattern marker) 226. Also depicted is a blue-colored color marker 232 (the word "blue" in the FIG. 2*d* is meant to indicate that marker 232 is blue-colored, not that the word "blue" is written on marker 232). Moreover, FIG. 2*d* depicts "compound" marker 234, wherein two attributes—color and shape, are used as the basis for visual association. Specifically, compound marker 234 comprises a green-colored semi-circle (wherein the letter "G" appearing in FIG. 2*d* is meant to indicate that the semi-circle is green in color).

Tags for use in conjunction with method 100 can be realized in a variety of physical forms. Examples of such forms, include, without limitation, a headband, an armband, a waistband or belt, a vest, a jersey, a patch that is preferably removably-attachable to a jersey or vest, and a flag that is preferably removably-attachable to a belt. Such forms, sans marker, are well known in the art.

Figure 3:
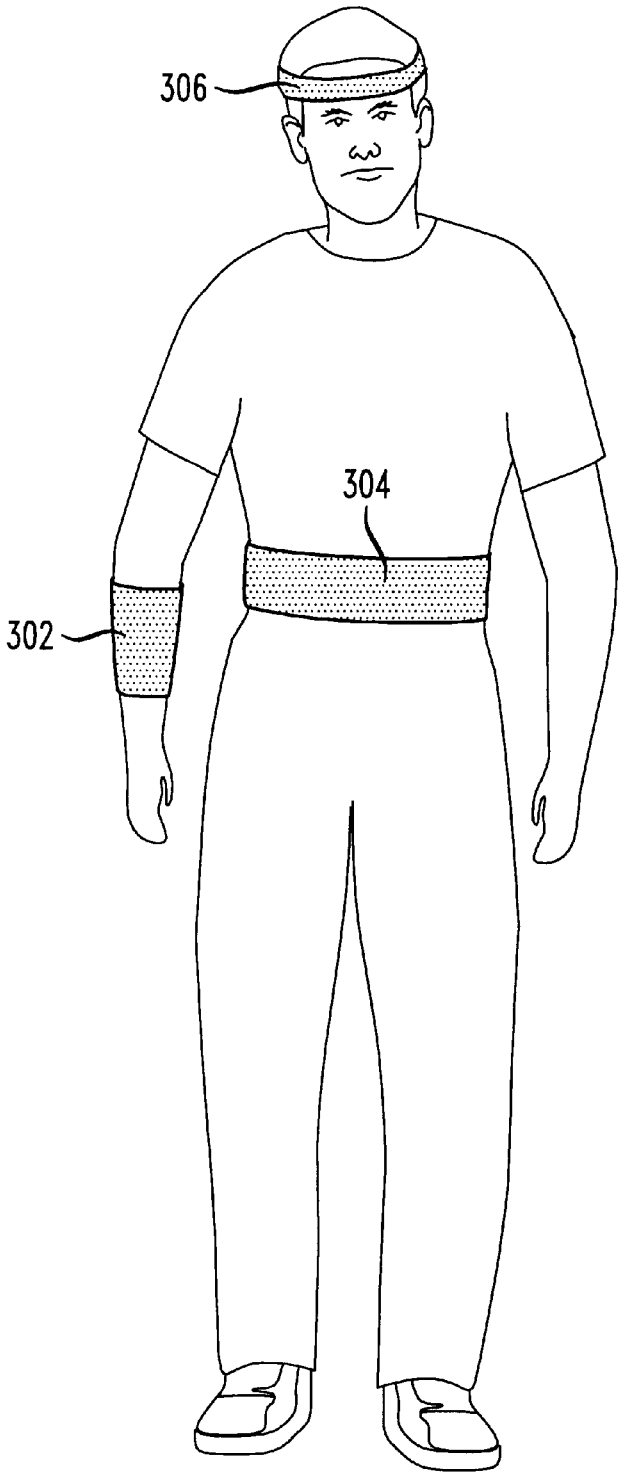
FIG. 3 depicts several illustrative tags, including a headband, a waist band and an armband in accordance with the present teachings.

To improve the visibility of markers used in conjunction with armbands or waistbands, the width of such tags is advantageously increased over standard-width armbands (1–3 inches) or belts (1–2 inches). In particular, armbands for use as tags in accordance with the present teachings have a width that is advantageously four or more inches, and waistbands have a width that is advantageously three or more inches. An embodiment of such an extra-wide armband 302 and an extra-wide waistband 304 are depicted in FIG. 3. Headband 306 is also depicted in FIG. 3. It is understood that while a player in FIG. 3 is depicted as wearing armband 302, waistband 304, and headband 306, only one such tag (e.g., the armband or the waistband or the headband) is typically worn by a player. To improve visibility, several tags can, however, be worn by a single player. Such tags should all possess the same marker (e.g., the same color, etc.).

Presently, there is no preference for any particular configuration of vests, jerseys, jerseys having a removable patch, belts having a removable flag, or the like for use in conjunction with the invention. Illustrative configurations of such articles are found in U.S. Pat. No. 5,694,651 (vest), U.S. Pat. No. 4,453,274 (jersey), U.S. Pat. No. 4,277,848 (jersey with removable patch) and U.S. Pat. No. 3,848,974 (jersey with removable patch). Each of those patents is incorporated by reference herein in its entirety.

Figure 1C:
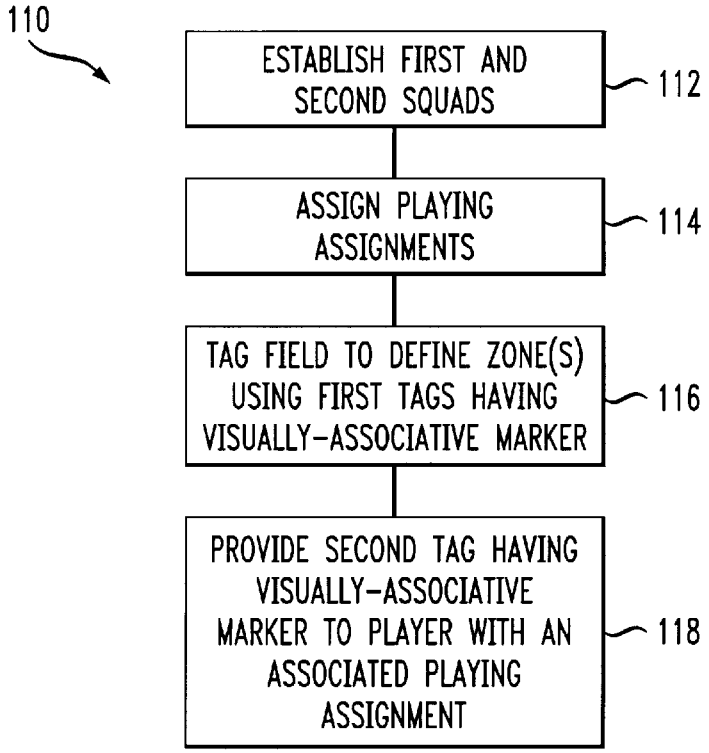
FIG. 1C depicts an embodiment of the instructional method of FIG. 1A, wherein the method is specifically adapted for teaching/learning zone defense.

FIG. 1C depicts, via flow chart, sports instructional method 110 for zone coverage in accordance with an illustrated embodiment of the present invention. In accordance with the operation block 112, first and second squads are established. In operation 114, a plurality of playing assignments are assigned to players on each of a first and a second squad as is appropriate for the team sport being played.

In operation 116, at least a portion of the playing field is demarcated into one or more regions or zones using one or more first tags. Each such zone corresponds, for example, to a portion of the field to be defended by a player having an associated playing assignment (previously defined). Each first tag is thus viewed as being "indicative" of a playing assignment (i.e., indicative of the associated playing assignment). Operation 116 is referred to herein as "tagging" the field.

In one embodiment, the first tag is line(s), such as may be formed by powder (e.g., lime), and the marker is the color of the line. The first tag is thus applied to the playing field to demarcate various zones, as appropriate for the team sport and the type of zone defense being used. If multiple zones are required, first tags indicative of different playing assignments are advantageously distinguished by the marker (i.e., color). Thus, for example, a "first" first tag is realized as lines having a white marker (i.e., white lines) and a "second" first tag is realized as lines having a red marker. In a further embodiment, a compound marker can be used, wherein the lines demarcating regions of the playing field can be broken or "dashed," etc., as well as colored. Such dashed lines may be used, for example, to distinguish the zones that are established for a first squad on one side of the field from zones that are established for a second squad on the other side of the field.

In another embodiment, each first tag comprises a plurality of colored "flags" that depend from thin flexible stakes or the like that are inserted into the field to define a zone. All flags used within a single group of such flags to define a particular zone have the same marker (e.g., the same color, pattern, etc.).

In operation 118, second tags are provided to the players as a function of playing assignments. In particular, a player having a playing assignment that requires providing defensive coverage in a particular zone (i.e., the associated playing assignment) is given a second tag that is visually associative of the first tag that defines that zone. For example, if a zone is defined by white lines, the second tag can be, for example, a white armband. As the first tag defining a particular zone is visually distinctive from other first tags defining other zones, the second tag provided to a given player will therefore be different from other second tags provided to other players having different coverage assignments in other zones.

Turning to football for an example, assume that a region of a football field that a corner back must defend in zone play is defined by orange lines. In use, the first tag is thus indicative of the playing assignment "corner back." The second tag that is provided to the player having the associated playing assignment (i.e., the corner back) is advantageously orange (and therefore visually associative of the first tag) and may be embodied in any the ways previously described (e.g., arm band, etc.).

Having described specific embodiments of sports instructional method 10 by way of methods 100 and 110, further description of method 10 (FIG. 1A) is now appropriate. Operation 20 of method 10 requires that a first tag be provided. Such a first tag, in use, is indicative of a first playing assignment. In the context of man-to-man play (method 100), operation 20 corresponds to providing a tag to a player on a first playing squad (operation 108). The first tag is thus indicative of the playing assignment of the player wearing the tag. In the context of zone play (method 110), operation 20 corresponds to tagging the playing field to demarcate a zone (operation 116). The first tag is thus indicative of a playing assignment that requires defending the demarcated zone.

Operation 40 of method 10 requires providing a second tag to a player having an "associated" playing assignment. As implemented for teaching man-to-man defense, operation 40 of method 10 corresponds to providing a second tag to a player on the second playing squad that is "matched" to a player on the first squad, wherein the second tag is visually associative of the first tag (operation 108). As implemented for teaching zone defense, operation 40 corresponds to providing a second tag to a player having an "associated" playing assignment, wherein the second tag is visually associative of the first tag used for demarcating the zone that the player must defend (operation 118).

Thus, it is seen that while the present method is embodied differently for man-to-man defensive play (method 100) than for zone defensive play (method 110), such embodiments are simply different implementations of the same method. In method 100 (man-to-man), players (or playing assignments) are matched, while in method 110, a player is matched to a region of the playing field. In both cases, however, the match is facilitated through the use of tags having visually-associative markers in accordance with the present teachings.

It is recognized by those that are familiar with team sports that, in many cases, it is desirable to have some of the players of a squad play a man-to-man defense while others play zone defense, thereby presenting a "hybrid" defense. The decision as to which players should play man-to-man defense and which players should play zone defense can be based on several considerations. Such considerations include, without limitation, the nature of the sport, the specifics of the playing assignment, the capability of the players, variation in skill levels between two players who would be matched up in man-to-man play, etc.

Figure 1D:
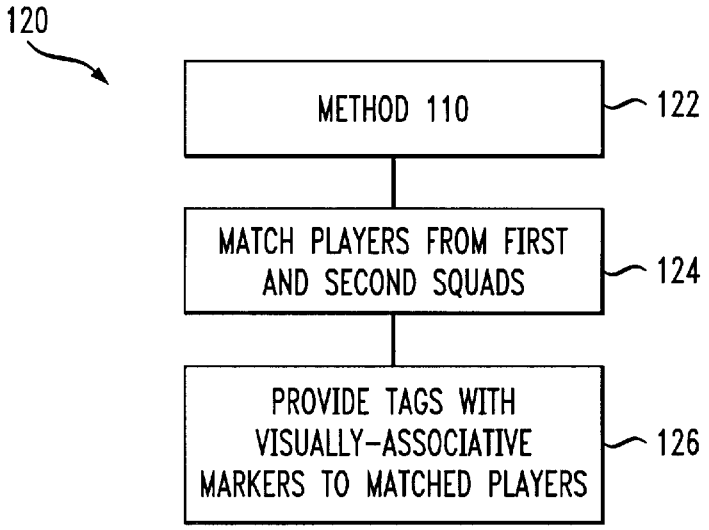
FIG. 1D depicts an embodiment of the instructional method of FIG. 1A, wherein the method is specifically adapted for teaching/learning a hybrid defense.

Thus, in a third embodiment of the present invention, which is depicted by illustrative method 120 in FIG. 1D, a sports instructional method for hydrid defensive play is provided. Method 120 is a synthesis of methods 100 and 110.

As depicted in FIG. 1D, method 120 includes method 110 for zone play, wherein a player that provides defensive coverage in a particular zone is given a second tag that is visually associative of a first tag that is used to define that zone. Method 120 further includes operations 124 and 126 pertaining to man-to-man play, which correspond to operations 106 and 108 of method 100. In operation 124, for those players or positions in which man-to-man play is desired, players from the first squad are "matched," as appropriate, with players from the second squad as a function of their playing assignments. In operation 126, tags are provided to matched players. More particularly, given matched players, a third tag is provided to a player on the first squad, and a fourth tag is provided to a player on the second squad, wherein the third and fourth tags are visually associative of one another, as previously described.

It should be understood that method 120 could alternatively be implemented by adding operations 116 and 118 for zone defense to method 100.

The present invention is further described with reference to the following Examples, which are provided by way of illustration, not limitation. Examples I–IV illustrate the use of the present invention in the context of man-to-man play in conjunction with several illustrative team sports. Example V illustrates the use of the present invention in the context of a zone or hybrid defense.

EXAMPLE I

Basketball

Figure 4:
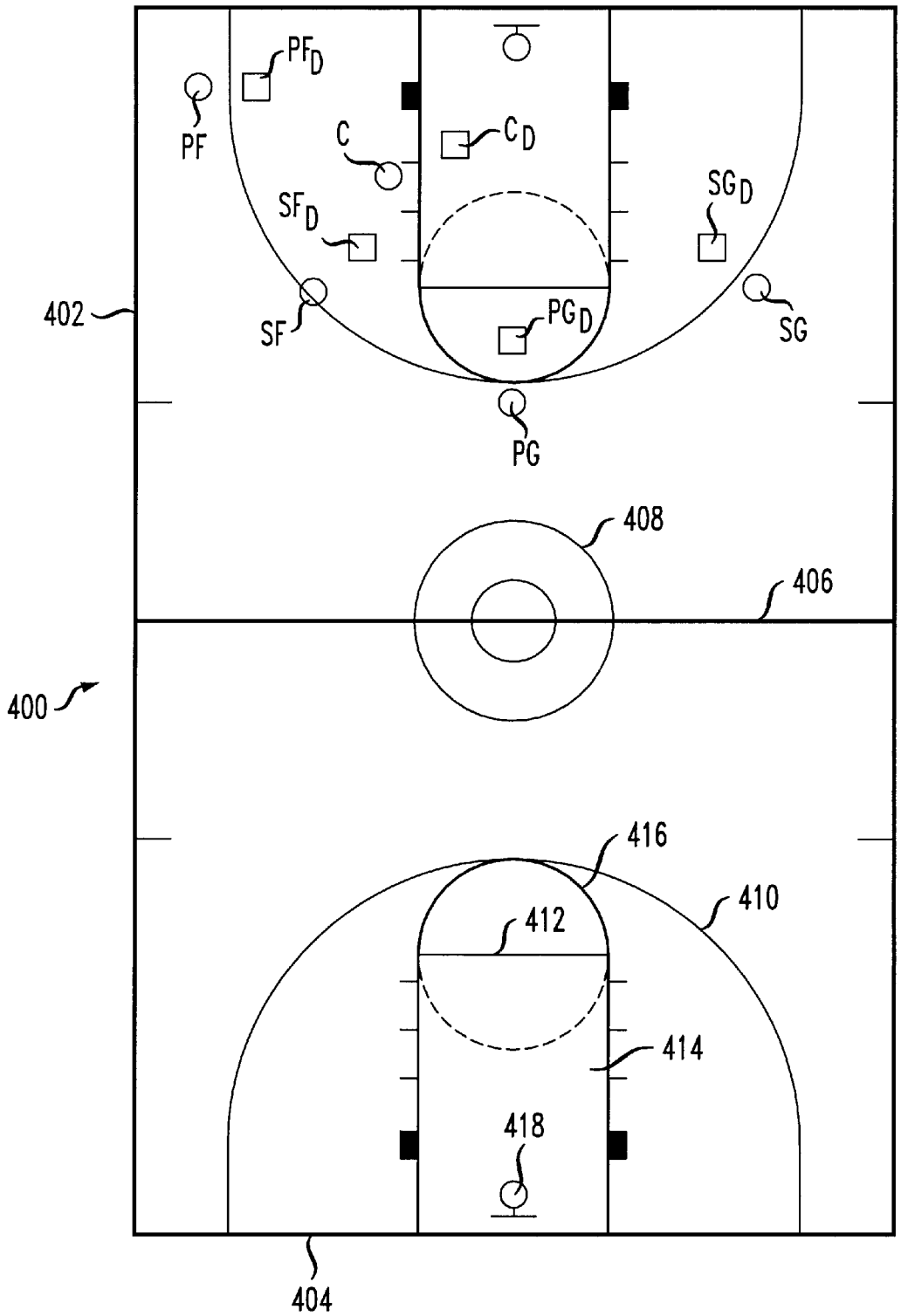
FIG. 4 PRIOR ART
FIG. 4 depicts a conventional basketball court and two squads of basketball players.

FIG. 4 depicts a basketball court 400 that is configured in the usual manner. Court 400 includes sidelines 402, baseline 404, midcourt line 406, center circle 408, three-point arc 410, free throw line 412, free throw lane 414, circle 416 and basket 418. Also depicted in FIG. 4 are two basketball squads, SQUAD 1 and SQUAD 2, each having five players. SQUAD 1 players are each denoted by a circle and SQUAD 2 players are each denoted by a square. For the purpose of this Example, SQUAD 1 is assumed to be in possession and SQUAD 2 is assumed to be on defense. It is understood, of course, that the squad in possession of the ball changes many times during a game. FIG. 4 is simply a "snap shot" of play.

The following playing assignments are assigned to the players of SQUAD 1: "point guard" to player PG, "shooting guard" to player SG, "small forward" to player SF, "power forward" to player PF and "center" to player C. The same playing assignments are assigned to the players of SQUAD 2: "point guard" to player $PG_D$, "shooting guard" to player $SG_D$, "small forward" to player $SF_D$, "power forward" to player $PF_D$ and "center" to player $C_D$. The duties and responsibilities of such playing assignments are not described here as they are well understood by those who are familiar with basketball.

For the present embodiment, players having the same playing assignment are matched (e.g., player $C_D$ (the center) of SQUAD 2 is matched to player C (the center) of SQUAD 1). In the present embodiment, the tags that are provided to the basketball players are headbands, and the marker is the color of the headband or a pattern appearing thereon. An illustrative marker distribution is listed below in Table I.

TABLE I

| SQUAD 1 | | SQUAD 2 | |
|---|---|---|---|
| Player | Marker | Player | Marker |
| PG | Blue | $PG_D$ | Blue |
| SG | Red | $SG_D$ | Red |
| SF | Yellow | $SF_D$ | Yellow |
| PF | Orange | $PF_D$ | Orange |
| C | Black Dots on a white background | C | Black Dots on a white background |

In other embodiments, the players of the squads are matched differently than as shown in Table I. It is within the capabilities of those skilled in the art, such as basketball coaches, to provide such different match ups. Moreover, in other embodiments, the tags have a different physical form and a different marker is used than in the illustrated embodiment.

EXAMPLE II

Hockey

Figure 5:
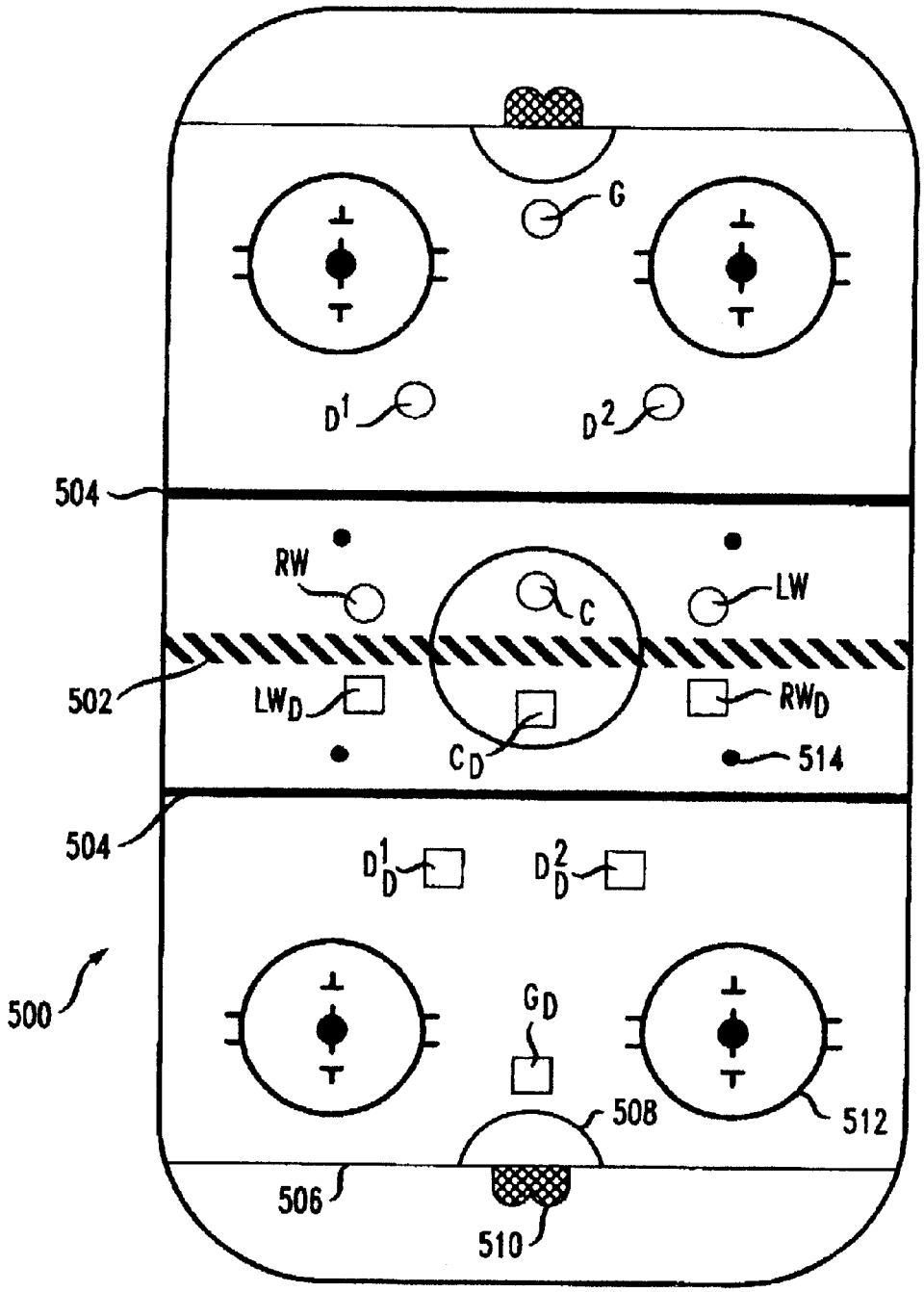
FIG. 5 PRIOR ART
FIG. 5 depicts a conventional hockey rink and two squads of hockey players.

FIG. 5 depicts a hockey rink 500 that is configured in the usual manner. Rink 500 includes red line 502, blue lines 504, goal line 506, crease 508, goal 510, face-off circle 512 and face-off spot 514 Also depicted in FIG. 5 are two hockey squads, SQUAD 3 and SQUAD 4, each having six players. SQUAD 3 players are each denoted by a circle and SQUAD 4 players are each denoted by a square. For the purpose of this Example, SQUAD 3 is assumed to be in possession and SQUAD 4 is assumed to be on defense. It is understood, of course, that the squad in possession of the puck changes many times during a game.

The following playing assignments are assigned to the players of SQUAD 3: "center" to player C, "right wing" to player RW, "left wing" to player LW, "defenseman" to player $D^1$, "defenseman"to player $D^2$, and "goalkeeper" to player G. The same playing assignments are assigned to the players of SQUAD 4: "center" to player $C_D$, "right wing" to player $RW_D$, "left wing" to player $LW_D$, "defenseman" to player $D^1{}_D$, "defenseman" to player $D^2{}_D$, and "goalkeeper" to player $G_D$. The duties and responsibilities of such playing assignments are not described herein as they are well understood by those who are familiar with hockey.

For the present embodiment, only the "forwards" (i.e., the right and left wings and the center) are matched. More particularly, player $C_D$ (center) of SQUAD 3 is matched to player C (center) of SQUAD 4, player $LW_D$ (left wing) of SQUAD 4 is matched to player RW (right wing) of SQUAD 3 and player $RW_D$ (right wing) of SQUAD 4 is matched to player LW (left wing) of SQUAD 3. The defensemen are assigned zone responsibilities (not indicated here). In other embodiments, the defensemen of opposing squads can be matched, as well.

In the present embodiment, the tags that are provided to the hockey players are armbands, and the marker is a shape appearing thereon. An illustrative marker distribution is listed below in Table II. In other embodiments, the tags have a different physical form and a different marker is used.

TABLE II

| SQUAD 3 | | SQUAD 4 | |
|---|---|---|---|
| Player | Marker | Player | Marker |
| C | diamond | C | diamond |
| RW | triangle | $RW_D$ | semi-circle |
| LW | semi-circle | $LW_D$ | triangle |
| $D^1$ | — | $D^1_D$ | — |
| $D^2$ | — | $D^2_D$ | — |
| G | — | G | — |

EXAMPLE III

Soccer

Figure 6:
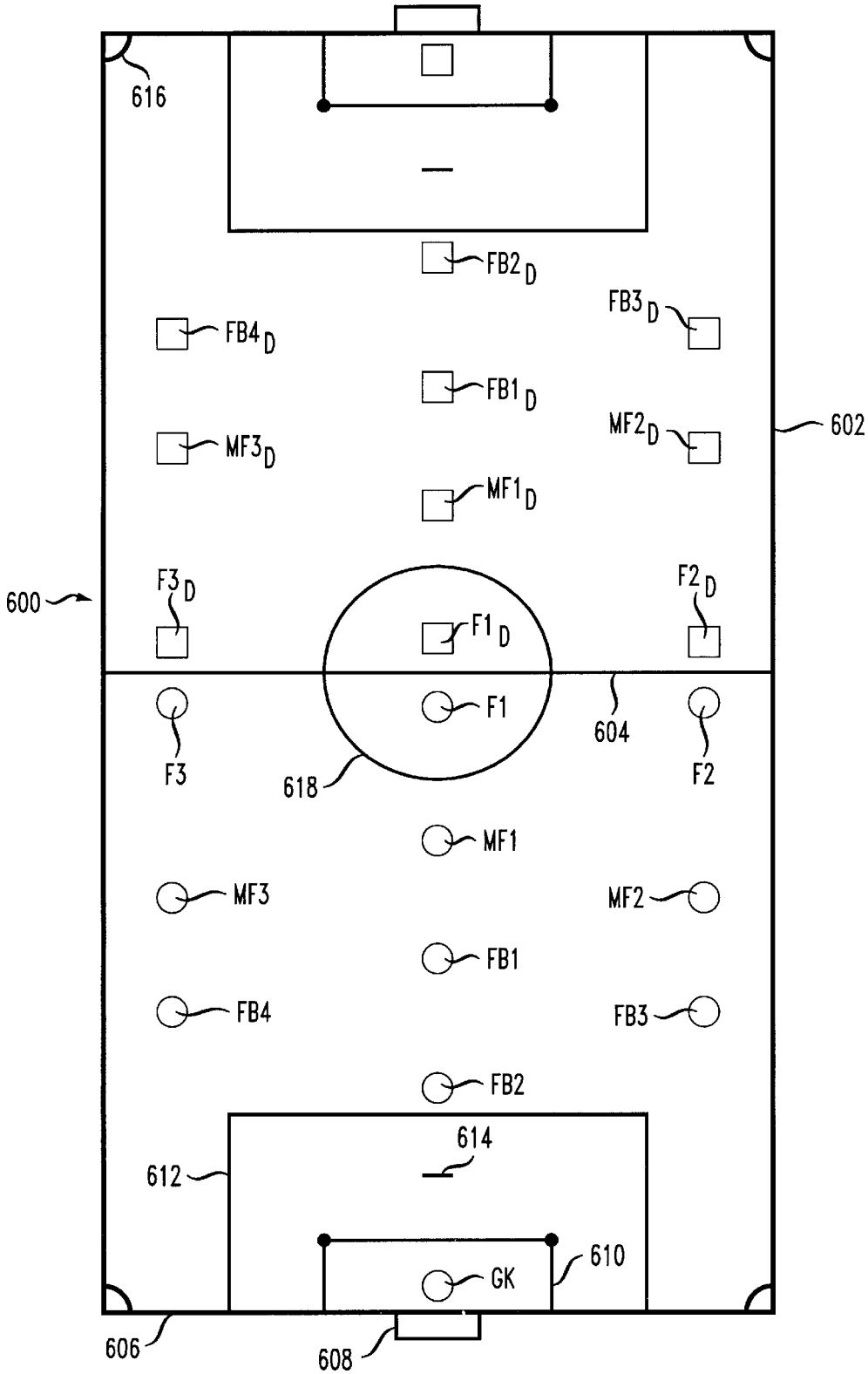
FIG. 6 PRIOR ART
FIG. 6 depicts a conventional soccer field and two squads of soccer players.

FIG. 6 depicts a soccer field 600 that is configured in the usual manner. Field 600 includes side line 602, center line 604, end line 606, goal 608, goal area 610, penalty area 612, penalty mark 614, corner arc 616 and center circle 618. Also depicted in FIG. 6 are two soccer squads, SQUAD 5 and SQUAD 6, each having eleven players. SQUAD 5 players are each denoted by a circle and SQUAD 6 players are each denoted by a square. For the purpose of this Example, SQUAD 5 is assumed to be in possession and SQUAD 6 is assumed to be on defense. It is understood, of course, that the squad in possession of the ball changes many times during a game.

The following playing assignments are assigned to the players of SQUAD 5: "forward" to players F1–F3, "midfielder" to players MF1–MF3, "fullback" to players FB1–FB4, "goalkeeper" to player GK. The same playing assignments are assigned to the players of SQUAD 6: "forward" to players $F1_D$–$F3_D$, "midfielder" to players $MF1_D$–$MF3_D$, "fullback" to players $FB1_D$–$FB4_D$, "goalkeeper" to player $GK_D$. The duties and responsibilities of such playing assignments are not described herein as they are well understood by those who are familiar with soccer. Moreover, it is understood by those skilled in the art that in other embodiments, playing assignments are allocated differently than in the "4-3-3" setup (i.e., four "fullbacks," three "midfielders," and three "forwards") of the present example. For example, other typical setups include "4-4-2," "3-4-4" and "3-5-2". Furthermore, the two squads can individually use different setups (e.g., SQUAD 5: 3-4-3 and SQUAD 6: 4-4-2).

In an illustrative embodiment, players having the playing assignment of "full back" are matched to players having the playing assignment of "forward" and players having the playing assignment "midfielder" are matched to each other. The goalkeepers are not, of course, matched. It will be understood that in other embodiments not using a 4-3-3 setup, the players may be matched differently than described here.

In the present embodiment, the tags are realized as jerseys, and the marker is a shape and the color of the shape. An illustrative marker distribution is listed below in Table III. In other embodiments, the tags have a different physical form and a different marker is used.

Note that in the illustrative matching operation used for this Example, one of the players having the playing assignment "full back" from each squad is "unassigned" (i.e., not matched to another player). That unassigned player may be given a zone assignment (not described here).

TABLE III

| SQUAD 5 | | SQUAD 6 | |
|---|---|---|---|
| Player | Marker | Player | Marker |
| F1 | red triangle | $F1_D$ | red circle |
| F2 | blue triangle | $F2_D$ | blue circle |
| F3 | yellow triangle | $F3_D$ | yellow circle |
| MF1 | red square | $MF1_D$ | red square |
| MF2 | blue square | $MF2_D$ | blue square |
| MF3 | yellow square | $MF3_D$ | yellow square |
| FB1 | red circle | $FB1_D$ | red triangle |
| FB2 | — | $FB2_D$ | — |
| FB3 | blue circle | $FB3_D$ | blue triangle |
| FB4 | yellow circle | $FB4_D$ | yellow triangle |

EXAMPLE IV

Football

Figure 7:
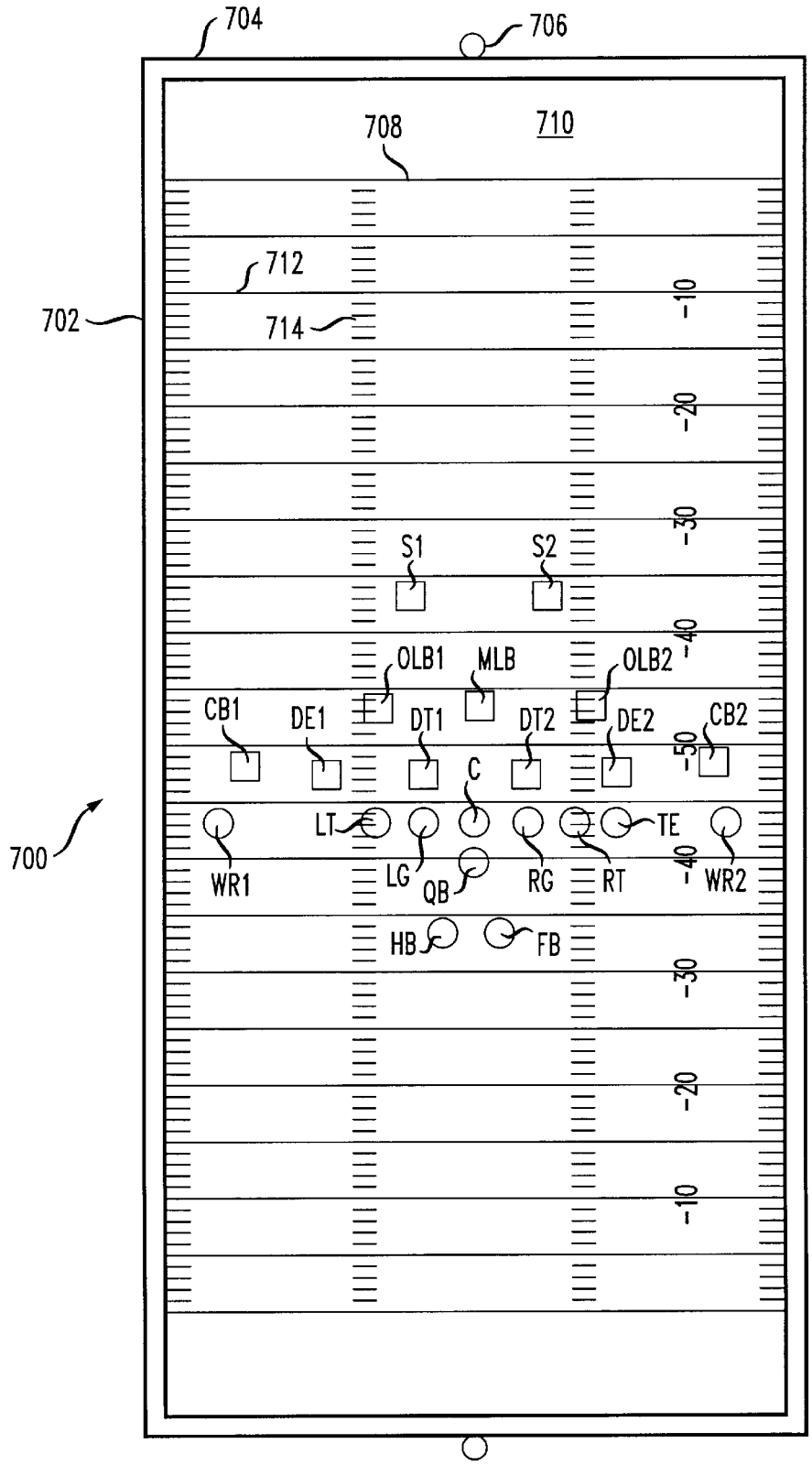
FIG. 7 PRIOR ART
FIG. 7 depicts a conventional football field and two squads of football players.

FIG. 7 depicts a football field 700 that is configured in the usual manner. Field 700 includes side line 702, end line 704, goal post 706, goal line 708, end zone 710, five yard lines 712, hash marks 714. Also depicted in FIG. 7 are two football squads, SQUAD 7 and SQUAD 8, each having eleven players. SQUAD 7 players are each denoted by a circle and SQUAD 8 players are each denoted by a square. As is well-known, football uses dedicated defensive and offensive squads. Thus, unlike the squads of EXAMPLES I–III, SQUAD 7 is on the field only while it is in possession of the ball. Likewise, SQUAD 8 is on the field only while SQUAD 7 is in possession.

The following playing assignments are assigned to the players of SQUAD 7: "wide receiver" to players WR1 and WR2, "tight end" to player TE, "left tackle" to player LT, "right tackle" to player RT, "left guard" to player LG, "right guard" to player RG, "center" to player C, "quarterback" to player QB, "half back" to player HB and "full back" to player FB. The playing assignments assigned to the players of SQUAD 8 are as follows: "defensive tackle" to players DT1 and DT2, "defensive end" to players DE1 and DE2, "cornerback" to players CB1 and CB2, "outside linebacker" to players OLB1 and OLB2, "middle linebacker" to player MLB and "safety" to players S1 and S2. Such playing assignments are not described herein as they are understood by those who are familiar with football.

In the present embodiment, the tags are implemented as vests, and the marker is a color. An illustrative marker distribution is listed below in Table IV. In other embodiments, the tags have a different physical form and a different marker is used.

TABLE IV

| SQUAD 7 | | SQUAD 8 | |
|---|---|---|---|
| Player | Marker | Player | Marker |
| LT | Blue | DE1 | Blue |
| LG | Blue | DT1 | Blue |
| C | Blue/Red | | |
| RG | Red | DT2 | Red |
| RT | Red | DE2 | Red |
| WR1 | Green | CB1 | Green |
| WR2 | Yellow | CB2 | Yellow |
| TE | Purple | | |
| | | OLB1 | Purple |
| HB | Purple | MLB | Purple |
| FB | Purple | OLB2 | Purple |

TABLE IV-continued

| SQUAD 7 | | SQUAD 8 | |
|---|---|---|---|
| Player | Marker | Player | Marker |
| QB | — | S1 | — |
| | | S2 | — |

Thus, in the present embodiment, players on the left side of the offensive line (i.e., players LT and LG) are matched, via a tag having a blue marker, to players on the right side of the defensive line (i.e., players DE1 and DT1). Similarly, players on the right side of the defensive line (i.e., players RT and RG) are matched, via a tag having a red marker, to players on the left side of the defensive line (i.e., players DE2 and DT2). Player C has a tag that is both red and blue, indicating that he can block players on either the right side or the left side of the defensive line.

Player CB1 is matched to player WR1 via a tag with a green marker, and player CB2 is matched to player WR2 via a tag with a yellow marker. Players OLB1, MLB and OLB2 are matched to players TE, HB and FB via a tag with a purple marker. In the present embodiment, players QB, S1 and S2 are not matched to other players.

EXAMPLE V

Soccer

Figure 8:
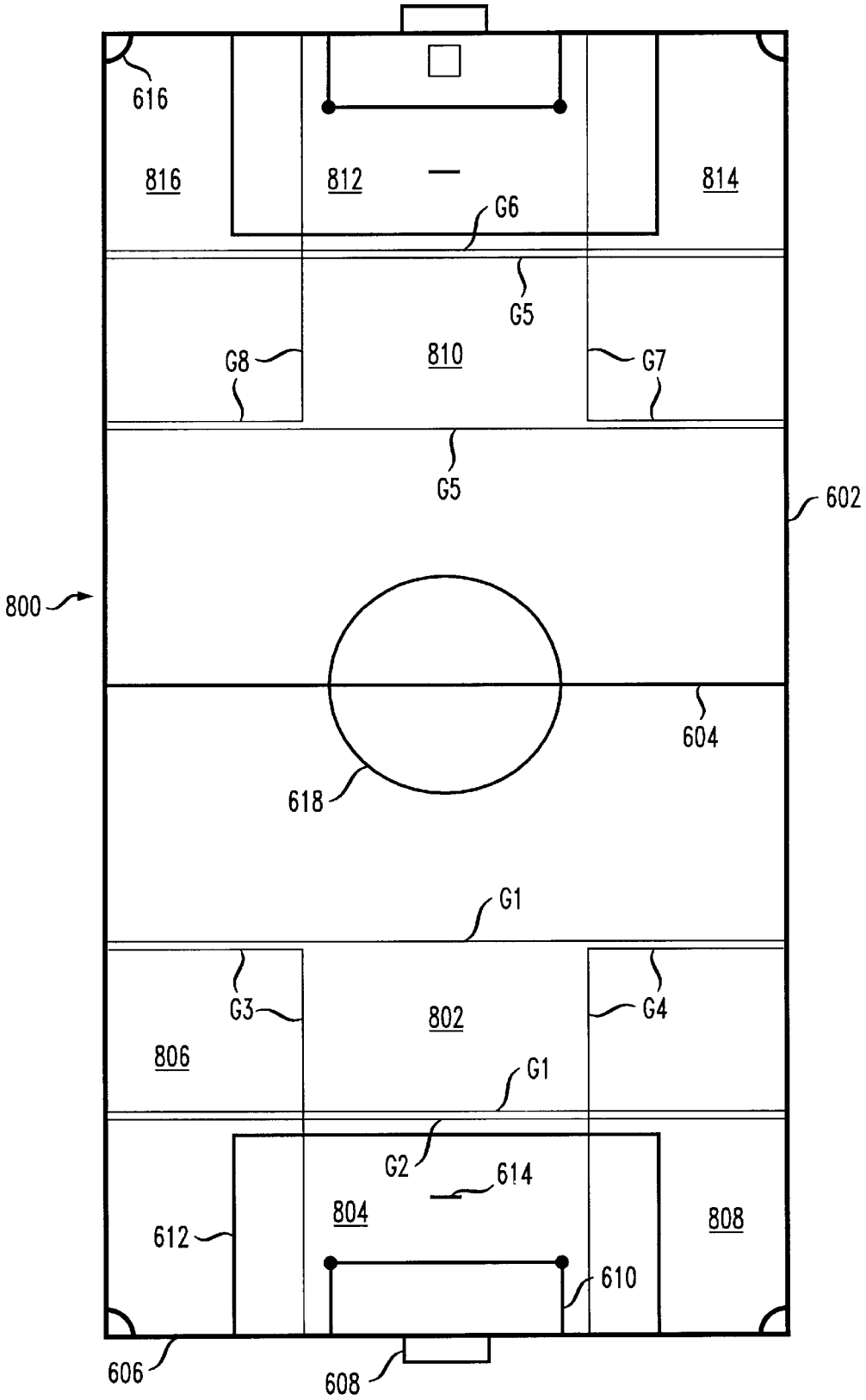
FIG. 8 depicts a soccer field that is "tagged" for teaching zone defense in accordance with the present invention.

FIG. 8 depicts a soccer field 800 tagged for zone play or hybrid defensive play in accordance with the present invention. Soccer field 800 includes the usual field marks, including side line 602, center line 604, end line 606, goal 608, goal area 610, penalty area 612, penalty mark 614, corner arc 616 and center circle 618. Moreover, in accordance with the present invention, field 800 includes several non-standard field marks that demarcate several regions or zones 802, 804, 806, 808 and 810, 812, 814, 816 within soccer field 800. Zone 802 is defined by tag G1 and sidelines 602. Zone 804 is defined by tag G2, end line 606, and sidelines 602. Zone 806 is defined by tag G3, end line 606 an sideline 602. And zone 808 is defined by tag G4, end line 606 and sideline 602. Zones 810, 812, 814 and 816 on the opposite end of soccer field 800 are similarly defined by respective tags G5, G6, G7 and G8 in conjunction with the appropriate side line(s) 602 and end line 606.

For the present illustration, zones 802, 804, 806 and 808 demarcate respective defensive assignments of four fullbacks (not shown) FB1–FB4 of squad A in zone play. Similarly, zones 810, 812, 814 and 816 demarcate respective defensive assignments of four fullbacks (not shown) $FB1_B$–$FB4_B$ of a squad B in zone play. In other words, when a given squad (A or B) is in a defensive posture (i.e., not in possession), the four fullbacks or "defenders" of that squad should drop into their assigned zones to defend. An illustrative marker distribution is listed below in Table V.

TABLE V

| First Tag | | | Second Tag | | |
|---|---|---|---|---|---|
| Zone | Tag | Marker | Squad | Player | Marker |
| 802 | G1 | White | A | FB1 | White |
| 804 | G2 | Blue | A | FB2 | Blue |
| 806 | G3 | Red | A | FB3 | Red |

TABLE V-continued

| First Tag | | | Second Tag | | |
|---|---|---|---|---|---|
| Zone | Tag | Marker | Squad | Player | Marker |
| 808 | G4 | Yellow | A | FB4 | Yellow |
| 810 | G5 | Dashed White | B | $FB1_B$ | White Dots |
| 812 | G6 | Dashed Blue | B | $FB2_B$ | Blue Dots |
| 814 | G7 | Dashed Red | B | $FB3_B$ | Red Dots |
| 816 | G8 | Dashed Yellow | B | $FB4_B$ | Yellow Dots |

In accordance with method 110, a player having a playing assignment that requires providing defensive coverage in a particular zone is given a second tag that is visually associative of the first tag(s) that define zone. For example, player FB1 provides defensive coverage for zone 802 defined by first tag G1. In the present example, first tag G1 are "lines," such as may be formed by lime. The marker for first G1 is color—white. As such, player FB1 is provided with a second tag having a white marker (e.g., a white arm band).

In the present embodiment, "dashed" or "broken" lines are used to designate zones at the opposite end of soccer field 800. Thus, player $FB1_B$ provides defensive coverage for zone 810 defined by first tag G5. First tag G5 is again "lines," but a compound marker is used to distinguish squad B zones from squad A zones. In particular, the marker utilizes a pattern (broken or dashed lines) and color (white). Player $FB1_B$ is provided with a second tag having a compound marker to provide the requisite visual association to the broken white lines defining zone 810. In particular, the marker uses a pattern (colored dots on a black background) that can be associated with the broken lines of the squad B zones, in addition to color (white dots).

In the present example, the zones associated with squad A were tagged by first tags having a different marker than the zones for squad B (i.e., colored solid line vs. colored dashed line). In other embodiments, the markers for the zones of the different squads are the same. A coach can decide which approach to take as a function of the age/skill level of the players.

To illustrate the application of the present invention to a hybrid defensive, the "midfielders" are assumed to play man-to-man defense, and are matched to the midfielders of the opposing squad. An illustrative marker distribution for the midfielders is listed below in Table VI.

TABLE VI

| SQUAD A | | SQUAD B | |
|---|---|---|---|
| Player | Marker | Player | Marker |
| MF1 | green square | $MF1_B$ | green square |
| MF2 | green circle | $MF2_B$ | green circle |
| MF3 | green triangle | $MF3_B$ | green triangle |

It will be appreciated that some of the various illustrative embodiments of markers that are depicted in the Figures and that are described above may not be suitable for use with some physical implementations of the tag. In particular, if the tag is realized as a headband or an armband, then color is advantageously used as the marker in preference to shape, symbols or patterns. Size constraints imposed by a headband, and the visibility problems caused by rapid arm movements of a player in motion, render the use of shape, symbol and pattern markers impractical. Also, in embodiments in which tags are used to demarcate zones, color is again advantageously used as the marker. Moreover, while vests and jerseys are suitable for practice sessions, tags so implemented may obscure team uniforms and thus might not be suitable for use when playing against another team. It should also be clear that if, as is typical with junior sports leagues, a player changes playing assignments during the season, that player surrenders the tag that was provided for his/her first playing assignment and is provided with a new tag appropriate for his/her new playing assignment.

It is to be understood that the embodiments described herein are merely illustrative of the present invention. Other embodiments can be devised in application of the present teachings by those skilled in the art without departing from the scope and spirit of the invention. It is therefore intended that such other embodiments be included within the scope of the following claims and their equivalents.

I claim:

1. A sports instructional method comprising:

demarcating at least a first zone in a playing field using a first tag; and providing a second tag to at least one player from a first squad having a playing assignment that requires said one player to defend said first zone, wherein, said first tag and said second tag are visually associative of each other such that they have one or more similar or identical attributes that would enable an individual viewing said first and second tags to make an association or connection therebetween.

2. The method of claim 1, further comprising:

providing a third tag to a second player from said first squad; and providing a fourth tag to a player from a second squad that opposes the first squad in play, wherein:

said second player from said first squad and said player from said second squad have matched playing assignments, and said third and fourth tags are visually associative of each other such that they have one or more similar or identical attributes that would enable an individual viewing said third and fourth tags to make an association or connection therebetween.

3. The method of claim 2, wherein:

said first tag is a line; and said second tag is selected from the group consisting of a headband, an armband, a waistband, a vest, a jersey, a patch that is removably-attachable to a jersey or vest, and a flag that is removably-attachable to a belt, and said third and fourth tags are selected from the group consisting of a headband, an armband, a waistband, a vest, a jersey, a patch that is removably-attachable to a jersey or vest, and a flag that is removably-attachable to a belt.

* * * * *